US008177322B2

(12) United States Patent
Nakano et al.

(10) Patent No.: US 8,177,322 B2
(45) Date of Patent: May 15, 2012

(54) PRINTING APPARATUS AND PRINTING METHOD

(75) Inventors: Takatoshi Nakano, Tokyo (JP); Kiichiro Takahashi, Yokohama (JP); Tetsuya Edamura, Kawasaki (JE); Toshiyuki Chikuma, Tokyo (JP); Hirokazu Tanaka, Kawasaki (JP); Wakako Yamamoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 12/842,530

(22) Filed: Jul. 23, 2010

(65) Prior Publication Data

US 2011/0037806 A1 Feb. 17, 2011

(30) Foreign Application Priority Data

Aug. 11, 2009 (JP) ..... 2009-186576

(51) Int. Cl.
*B41J 29/393* (2006.01)

(52) U.S. Cl. ..... 347/19; 347/41

(58) Field of Classification Search ..... 347/12, 347/19, 41
See application file for complete search history.

(56) References Cited

U.S. PATENT DOCUMENTS

| | | | | |
|---|---|---|---|---|
| 6,164,756 | A | 12/2000 | Takahashi et al. | |
| 6,378,982 | B2 * | 4/2002 | Ono et al. | 347/41 |
| 6,454,390 | B1 | 9/2002 | Takahashi et al. | |
| 6,474,767 | B1 | 11/2002 | Teshigawara et al. | |
| 6,779,873 | B2 * | 8/2004 | Maeda et al. | 347/43 |
| 6,789,867 | B2 | 9/2004 | Takahashi et al. | |
| 7,380,896 | B2 * | 6/2008 | Wada | 347/12 |
| 7,641,309 | B2 | 1/2010 | Teshigawara et al. | |
| 2009/0051721 | A1 | 2/2009 | Takahashi et al. | |

FOREIGN PATENT DOCUMENTS

| | | |
|---|---|---|
| JP | 08-058083 | 3/1996 |

* cited by examiner

*Primary Examiner* — Lamson Nguyen
(74) *Attorney, Agent, or Firm* — Fitzpatrick, Cella, Harper & Scinto

(57) ABSTRACT

Quality degradation of a print image due to a deviation amount in a landing position of ink is prevented while suppressing degradation of through-put. In a method of completing a print to a unit region by at least one reciprocal scan to the unit region of a print medium by a printing head in which plural ink ejection ports are arrayed for ejecting ink, a printing rate in a scan direction where a deviation amount in a landing position of ink in an array direction of the ink ejection ports is relatively large is set relatively low and the printing rate in the scan direction where the deviation amount in the landing position of ink in the array direction of the ink ejection ports is relatively small is set relatively high.

10 Claims, 9 Drawing Sheets

PRINTING APPARATUS AND PRINTING METHOD

BACKGROUND OF THE INVENTION

1. Field of the Invention

The present invention relates to an inkjet printing apparatus and an inkjet printing method.

2. Description of the Related Art

For example, there are some cases where in a so-called serial scan type printer performing a print operation by reciprocally carrying a printing head onto a print medium, which is disclosed in Japanese Patent Laid-Open No. H08-058083 (1996), a deviation amount in a landing position of ink differs corresponding to a scan direction due to the structure of the printer, the posture of the printing head and the like. When the deviation amount in the landing position of the ink differs corresponding to the scan direction, there is possible generation of a so-called white stripe or black stripe, possibly degrading image quality of the printer.

Incidentally the technology disclosed in the above publication possibly invites degradation of through-put since a scan speed changes depending on the scan direction.

An object of the present invention is to provide a printer and a printing method which can restrict quality degradation of a print image due to a deviation amount in a landing position of ink while restricting degradation of through-put.

SUMMARY OF THE INVENTION

In a first aspect of the present invention, there is provided a printing apparatus includes a scanning unit configured to make a printing head execute scans of a printing medium in back and forth directions, the printing head having a plurality of arrayed ejection ports for ejecting ink and a controller configured to control the scanning unit and the printing head so as to make the printing head execute multiple scans of a unit region of the print medium and print an image thereon, wherein the controller controls each of printing rates of the printing head during the scans in the back and forth directions so as to lower a printing rate during one of the scans in the back and forth directions than that during the other, wherein the one causes a relatively large landing deviation of ink in an array direction of the ejection ports and the other causes a relatively small landing deviation of ink in the array direction.

In a second aspect of the present invention, there is provided a printing method having a step of making a printing head execute multiple scans of a unit region of a printing medium in back and forth directions and print an image thereon, the printing head having a plurality of arrayed ejection ports for ejecting ink and a step of controlling each of printing rates of the printing head during the scans in the back and forth directions so as to lower a printing rate during one of the scans in the back and forth directions than that during the other, wherein the one causes a relatively large landing deviation of ink in an array direction of the ejection ports and the other causes a relatively small landing deviation of ink in the array direction.

Further features of the present invention will become apparent from the following description of exemplary embodiments with reference to the attached drawings.

DESCRIPTION OF THE EMBODIMENTS

Hereinafter, a preferred embodiment of the present invention will be in detail explained exemplarily with reference to the attached drawings. However, components described in the embodiment are shown only as an example and the scope of the present invention is not limited thereto only.

Figure 1:
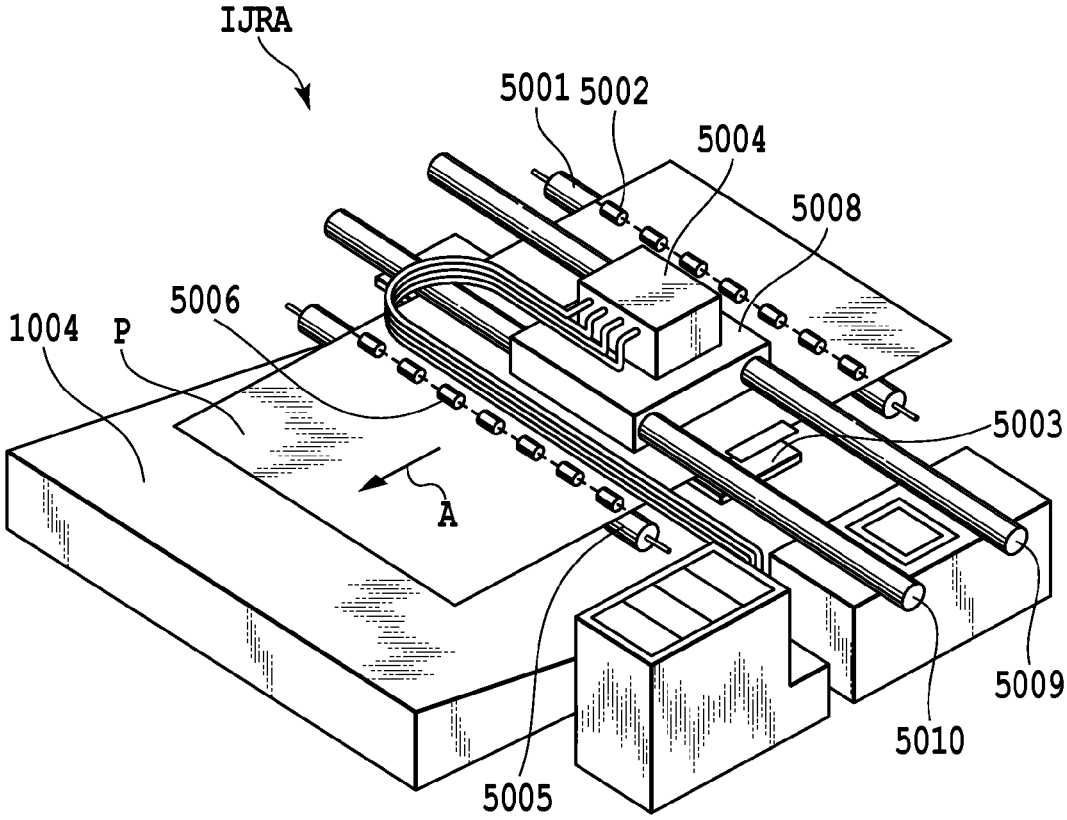
FIG. 1 is a perspective view showing an embodiment of an inkjet printer to which the present invention is applied.

FIG. 1 is a perspective view showing an arrangement of a printer IJRA as an inkjet printing apparatus to which the present invention is applied. A print medium P is fed to a nipping region formed between a conveying roller 5001, which is disposed on a conveying path of the print medium P, and a pinch roller 5002, which follows the conveying roller 5001 to rotate, by an automated feeding unit. The print medium is subsequently conveyed in a direction of an arrow A (a sub-scan direction) shown in the figure while being guided and supported on a platen 5003. The pinch roller 5002 is resiliently biased toward the conveying roller 5001 by biasing means such as a spring (not shown). The conveying roller 5001 and the pinch roller 5002 are constituent of a first conveying means disposed upstream in a conveying direction.

The platen 5003 is disposed a printing position facing to an ink ejection port formation surface (an ejection surface) of the inkjet-type printing head 5004 to support a reverse side of a print medium P and maintain a constant distance between an obverse side of a print medium P and the ejection surface. After a print medium P is conveyed on the platen and printed an image thereon, the print medium P is nipped between a discharging roller 5005, which is rotating, and a spur 5006 as a rotor, which follows the discharging roller 5005, thereby the print medium P is conveyed in the direction of A and discharged from the platen 5003 to a discharge tray 1004. The discharging roller 5005 and the spur 5006 are constituent of a second conveying means downstream in the conveying direction of the print medium P.

The printing head 5004 is removably mounted on a carriage 5008 so that the ejection surface of the printing head 5004 faces to the platen 5003 or a print medium P thereon. The carriage 5008 is moved back and forth along two guide rails 5009 and 5010 by driving force of a carriage motor. And the printing head 5004 performs an ink ejection operation in accordance with printing data in the back and forth movement. Further, an optical sensor (not shown) is mounted on the carriage 5008 downstream of the printing head 5004 in the conveying direction, which is used, such as when reading an optical characteristic of the after-mentioned test pattern. A traveling direction of the carriage 5008 intersects with a direction where the print medium is conveyed (a direction of an arrow A), which is called a "scan direction". On the other hand, the conveying direction of the print medium is called a "sub-scan direction". By alternately repeating a main scan (movement with a printing operation) of the carriage 5008 and the printing head 5004, and conveying of the print medium, a print to the print medium is performed.

Figure 2:
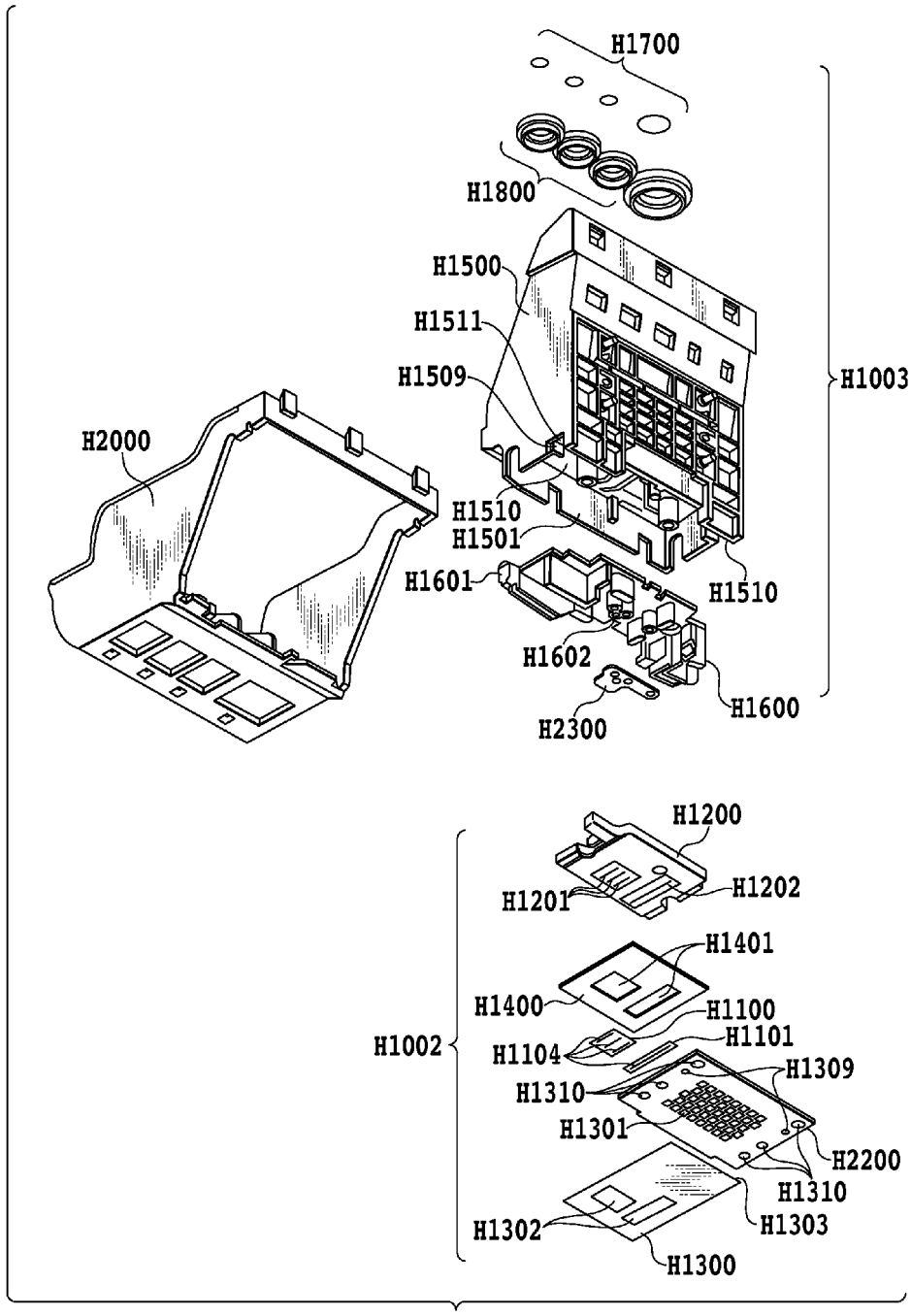
FIG. 2 is an exploded perspective view showing a printing head of the printer in FIG. 1.

FIG. 2 is an exploded perspective view showing the printing head of the printer IJRA. The printing head is a bubble jet (registered trademark) printing head which is a side shooter ejecting liquid droplets in a direction substantially perpendicular to a heater substrate. The printing head 5009 (H1001) includes a print element unit H1002, an ink supply unit H1003 and a tank holder H2000. The print element unit H1002 is configured by a first print element H1100, a second print element H1101, a first plate H1200, an electrical wiring tape H1300, an electrical contact substrate H2200 and a second plate H1400. The ink supply unit H1003 is configured by an ink supply member H1500, a flow passage forming member H1600, a joint rubber H2300, a filter H1700 and a sealing rubber H1800.

In the print element unit H1002, formation of a plate joint body (element substrate) by the jointing of the first plate and the second plate, mount of the print element to the plate joint body, lamination of the electrical wiring tape and electrical joint between the tape and the print element, sealing of the electrical connection portion and the like are carried out in that order. The first plate H1200 in which planarity is required in view of an influence on an ejection direction of the droplet is configured by, for example, an alumina ($Al_2O_3$) material having a thickness of 0.5 to 10 mm. In the first plate H1200, an ink supply port H1202 for supplying ink of black to the first print element H1100 and ink supply ports H1201 for supplying ink of cyan, magenta, yellow, and black are formed.

The second plate H1400 is a single sheet-shaped member having a thickness of 0.5 to 1 mm and has window-shaped openings H1401 each larger than a contour dimension of each of the first print element H1100 and the second print element H1101 bonded and fixed to the first plate H1200. The second plate H1400 is laminated and fixed with an adhesive agent on the first plate H1200 to form the plate joint body.

The first print element H1100 and the second print element H1101 are bonded and fixed to a surface of the first plate formed in the openings H1401. It is difficult to accurately mount the print element due to low positioning accuracy when bonding and fixing the first print element H1100 and the second print element H1101 to the first plate and displacement of the adhesive agent. An assembly error of the printing head can cause a landing deviation of ink to be described later.

Each of the print elements H1100 and H1101 having the print element arrays H1104 is formed of a well-known structure as a side shooter bubble jet (registered trademark) substrate. The print elements H1100 and H1101 have ink supply ports, heater arrays and electrode portions. A TAB tape is adopted in the electrical wiring tape (hereinafter, wiring tape) H1300. The TAB tape is a laminated body formed of a tape substrate (base film), a copper foil wire and a cover layer.

Inner leads H1302 as connection terminals extend in two sections of a device hole corresponding to the electrode portion of the print element. The wiring tape H1300 is bonded and fixed at a side of the cover layer to a surface (tape bonding surface) of the second plate through a thermosetting epoxy plastic bonding layer and the base film of the wiring tape H1300 serves as a smooth capping surface which a capping member of the print element unit is in contact with.

Figure 3:
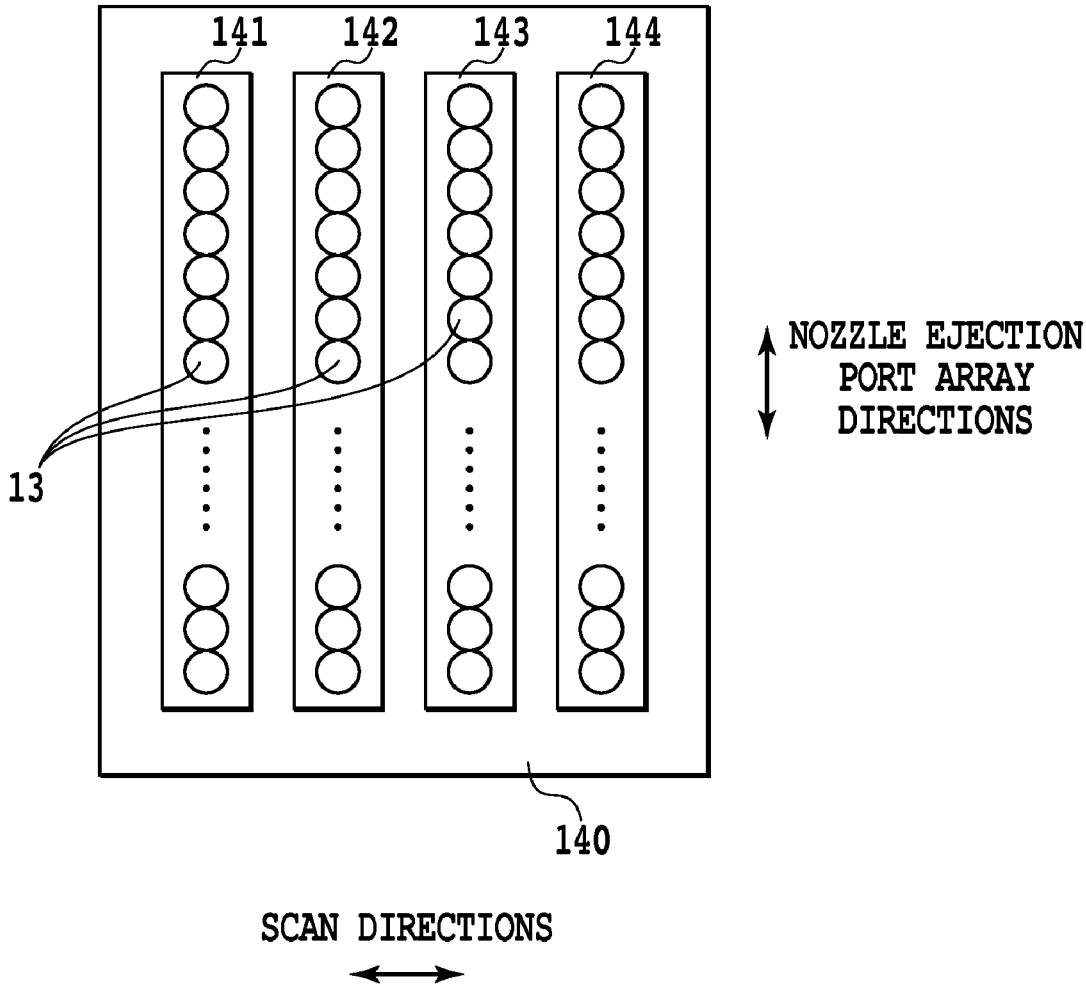
FIG. 3 is a view showing an arrangement of an ink ejection port forming surface of the printing head in the printer in FIG. 1.

FIG. 3 is a view showing an arrangement of an ink ejection port formation surface of the first print element H1100. As shown in FIG. 3, nozzle arrays 141 to 144 in each of which a plurality of ink ejection ports 13 are linearly arrayed for ejecting ink of cyan, magenta, yellow and black respectively are formed on the ink ejection port formation surface 140. The nozzle arrays 141 to 144 are arrayed in scan directions.

Figure 4:
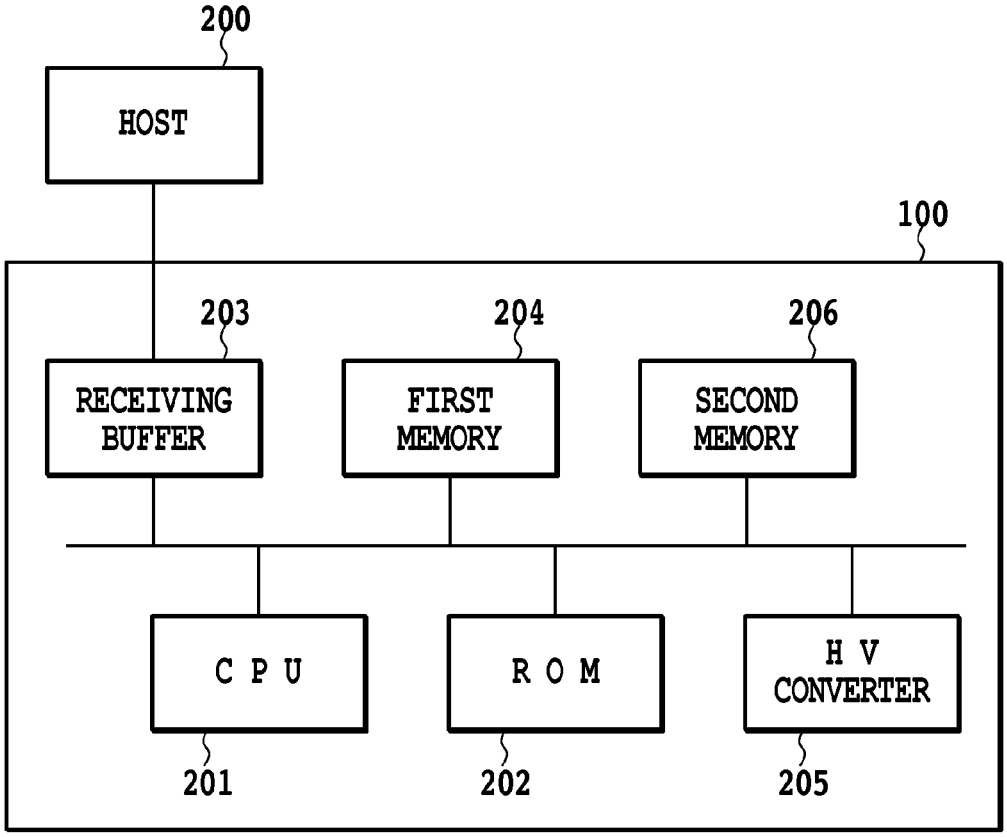
FIG. 4 is a block diagram showing an arrangement of a control system in the printer in FIG. 1.

FIG. 4 is a block diagram showing an arrangement of a control system in the printer. A control system 100 in the printer includes a CPU 201, a ROM 202, a receiving buffer 203, a first memory 204, a HV converter 205 and a second memory 206. The CPU 201 integrally controls the printer. A rotation of each of a carriage motor for driving the carriage 5008 to move, a conveying motor for driving the conveying roller 5001 and the discharging roller 5005 and the like is controlled by the CPU 201 through a motor driver. In addition, the CPU 201 controls a head driver in accordance with printing data so that each of the ejection ports of the printing head 5004 ejects ink. The ROM 202 stores control programs executed by the CPU 201, and a plurality of masks having different printing rates from each other used for a printing control as described below as well. The receiving buffer 203 stores print data in a raster unit received from a host 200. The print data stored in the receiving buffer 203 are compressed for reducing a transmission data amount from the host 200, which are stored in the first memory 204 after developed. The print data stored in the first memory 204 are subjected to HV conversion processing by the HV converter 205 and are stored in the second memory 206.

Next, a printing method according to an embodiment in the present invention will be explained. It should be noted that in the present embodiment, there is explained an example of a two-path print where a print of an image to a unit region of the print medium is completed by one back and forth scan, that is, two scans of the unit region of the print medium.

In the printing method of the present embodiment, a printing rate in the scan direction where a landing deviation of ink in the array direction of the ink ejection ports 13 of the printing head is relatively large is set relatively low and the printing rate in the scan direction where the landing deviation of ink in the array direction of the ink ejection ports 13 in the printing head is relatively small is set relatively high. At this time, it is preferable to define the printing rate corresponding to a difference between landing deviations of ink in respective scan directions. A method of acquiring the landing deviation in each scan direction will be described later. In addition, the printing rate is defined by a mask selectively allowing output of print data for performing a print on a print medium. The arrangement of the mask is well known and a detail explanation thereof is omitted, but not only a regular mask but also a mask of a gradation pattern may be used.

The definition of the printing rate in each path in an actual print operation may be provided as software of the CPU in FIG. 4 or as appropriate hardware, for example, a part of the circuit arrangement of the ASIC.

Here, Table 1 shows an example of setting a printing rate in a case where a landing deviation of ink by a scan in the forth direction is relatively small and a landing deviation of ink by a scan in the back direction is relatively large. That is, the printing rate in the back direction as the scan direction where the landing deviation of ink in the array direction of the ink ejection ports 13 is relatively large is as relatively low as 45%, and the printing rate in the forth direction as the scan direction where the landing deviation of ink in the array direction of the ink ejection ports 13 is relatively small is as relatively high as 55%. In a case where the landing deviation of ink in each scan direction does not occur, the printing rate is set as 50% in each of the back and forth directions. Here, the printing rate is a ratio of pixels allowing a print to pixels contained in a unit area. A general method of changing the printing rate is carried out by applying a mask pattern determining whether or not ejection of ink droplets is allowed for each pixel to binary print data determining ejection or non-ejection of ink droplets for each pixel to skip the print data.

TABLE 1

| | | |
|---|---|---|
| Printing rate [%] | Forth scan | 55 |
| | Back scan | 45 |

Figure 5A:
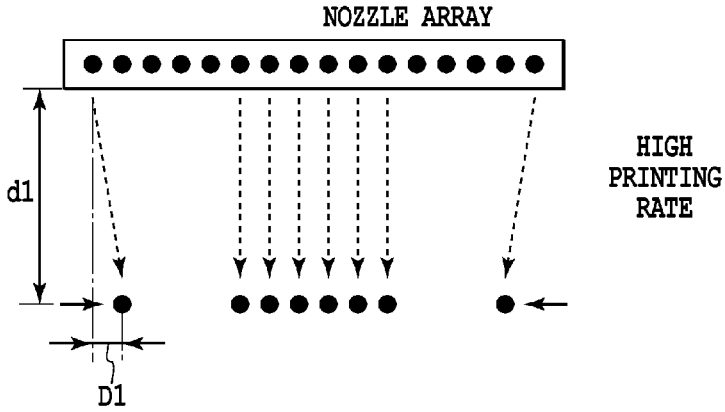
FIGS. 5A to 5C are views each explaining a generation cause of a landing deviation of ink.
Figure 5B:
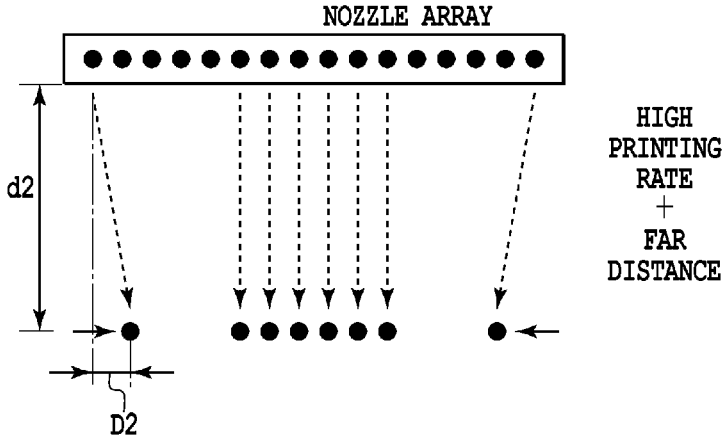
Figure 5C:
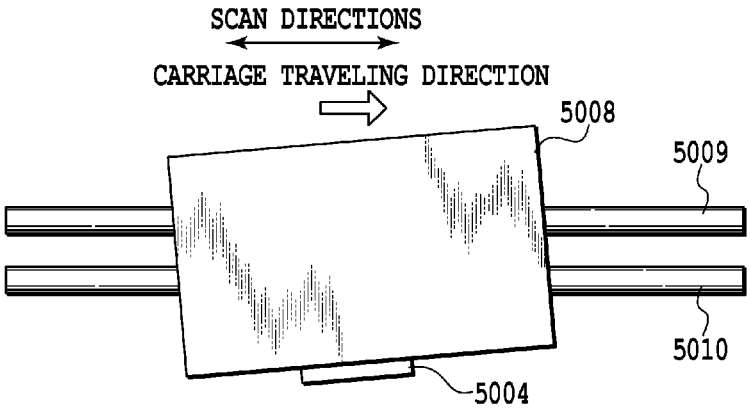

Next, an operation of the printing method in the present embodiment will be explained. Here, FIGS. 5A, 5B and 5C are conceptual views each explaining an occurrence cause of landing deviations of ink. FIG. 5A shows landing deviations of ink occurring in a state where a printing rate is relatively high. Here, d1 indicates a distance between a printing head (nozzle array) and a print medium. FIG. 5B shows landing deviations of ink occurring in a state where a distance between the printing head and the print medium is relatively distant under a condition where the printing rate is relatively high. In FIG. 5B, a distance between the printing head (nozzle array) and the print medium is longer than that in FIG. 5A. The distance is indicated by d2 (>d1).

When the printing rate is relatively high, an air immediately beneath the nozzle array is pushed away by ink droplets ejected from the nozzle array, so that air flow flowing toward a central region of the nozzle array in the array direction occurs. As a result, ink droplets ejected from end regions of a nozzle array tend to easily deviate toward the side of the central region, as understood from FIG. 5A. Here, D1 indicates a deviation of an ink droplet ejected from an ink ejection port located at the end region of the nozzle array.

In addition, when a distance between the printing head and the print medium becomes large, the landing deviation of ink becomes larger than that of FIG. 5A, as shown in FIG. 5B. That is, in FIG. 5B, a deviation of ink droplet ejected from an end port of the nozzle is indicated by D2, and D2 is larger than D1. Thus, a change of the distance between the printing head and the print medium causes a landing deviation of ink in the ejection port array direction. Especially, the landing deviations are different between in the back and forth directions.

In the present embodiment, the printing rate in the scan direction where the landing deviation of ink in the array direction of the ink ejection ports 13 is large is set relatively small, so that degradation of the image quality due to the landing deviation can be prevented.

In addition, one of the factors that distances between the printing head and the print medium are different between in the back and forth directions is a change of posture of the carriage. FIG. 5C shows a situation where a posture of the carriage is changed (inclined) thereby a front side of the carriage 5008 in the scan direction is distant from the print medium and a rear side of the carriage 5008 is close to the print medium. In this situation, nozzles located the front side in the scan direction are relatively far from the print medium, and nozzles located the rear side in the scan direction are relatively near to the print medium. If tensions of a belt moving the carriage 5008 along with the guide rails 5009, 5010 fluctuates in the back and forth directions, or there are different assembly errors between apparatuses, the posture (inclination) of the carriage is changed depending on the scan direction. As a result, the distance between the nozzle array and the print medium is changed depending on the scan direction so that the landing deviations in the back and forth directions can be different from each other.

Figure 6:
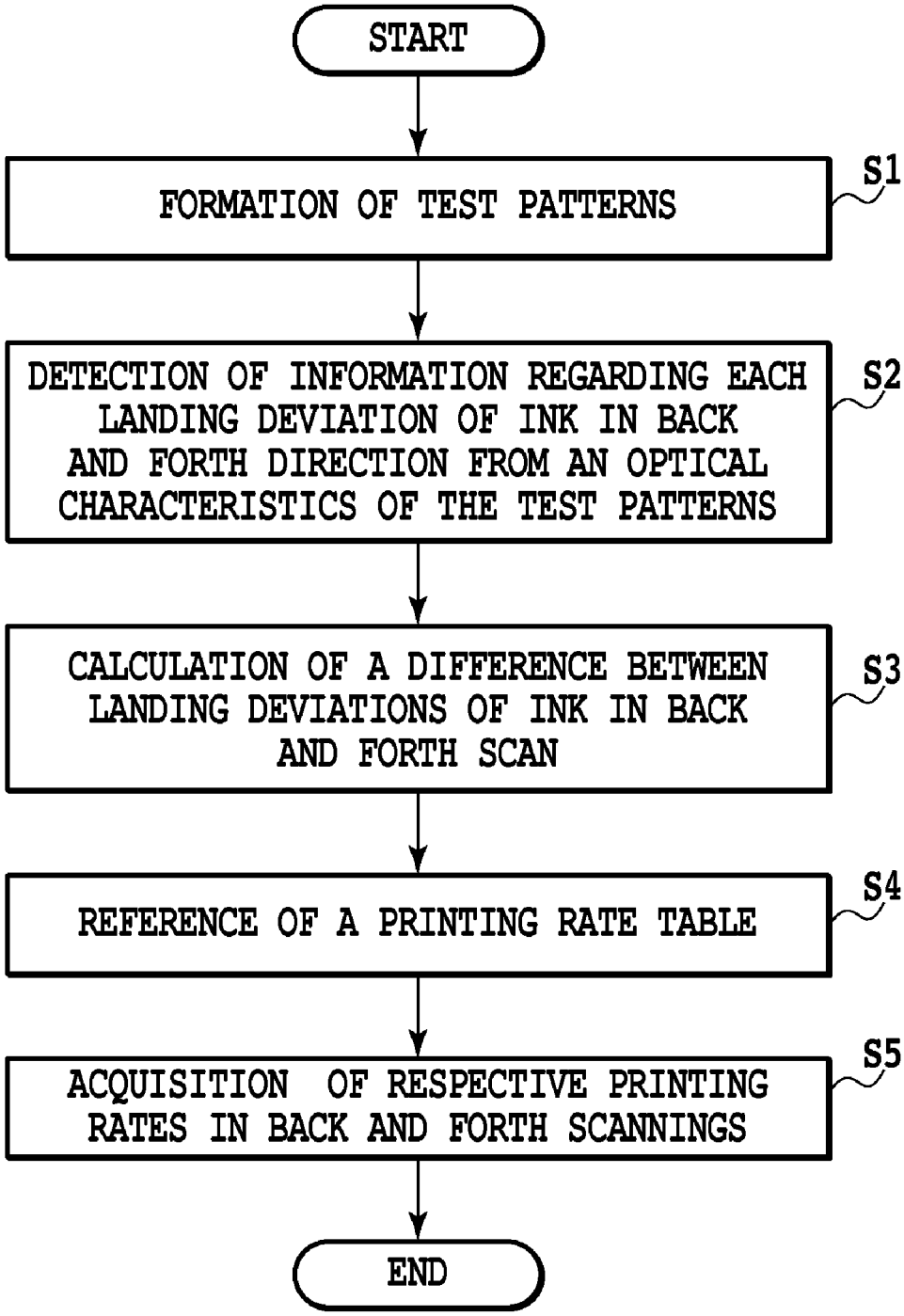
FIG. 6 is a flow chart showing an example of a setting procedure of a printing rate.

Next, an example of the setting procedure of the above printing rate will be explained. Here, FIG. 6 is a flow chart showing an example of the setting procedure of the printing rate in the printer.

First, a test pattern is formed for acquiring landing deviations of ink in the printer (S1). The test pattern is used for detecting information in regard to landing deviations of ink in each of a scan in the forth direction and a scan in the back direction. The production of the test pattern is to print plural test patches by differentiating a feeding amount of the print medium in a sub-scan direction. It should be noted that a method of producing the test pattern will be described later. In addition, a difference in optical characteristics between the respective test patches in the test pattern is used to detect information in regard to landing deviations of ink in each of a scan in the forth direction and a scan in the back direction (S2). Next, a difference between the landing deviations of ink respectively by the scan in the forth direction and the scan in the back direction is calculated (S3). Further, a printing rate table is referred to corresponding to the calculated difference between the landing deviations of ink respectively by the scan in the forth direction and the scan in the back direction (S4). As a result, the printing rate of each of the scan in the forth direction and the scan in the back direction is acquired (S5). Table 2 and table 3 show examples of the printing rate tables.

TABLE 2

| | | Difference between back and forth scan [μm] | | | | |
|---|---|---|---|---|---|---|
| | | −20 | −10 | 0 | +10 | +20 |
| Printing rate [%] | Forth scan | 70 | 60 | 50 | 40 | 30 |
| | Back scan | 30 | 40 | 50 | 60 | 70 |

TABLE 3

| | | Difference between back and forth scan [μm] | | | | |
|---|---|---|---|---|---|---|
| | | −20 | −10 | 0 | +10 | +20 |
| Printing rate [%] | Forth scan | 75 | 65 | 55 | 45 | 35 |
| | Back scan | 25 | 35 | 45 | 55 | 65 |

As apparent from Table 2, the printing rate is defined corresponding to a difference between the landing deviations of ink in the respective scan directions. In addition, in a case where the landing deviation of ink by each of the scan in the forth direction and the scan in the back direction originally differ from each other due to the configuration of the printer, it is, as shown in Table 3, possible to differentiate the printing rate between the respective scan directions also in a case where the difference between the landing deviations in the respective scan directions is zero.

Figure 7A:
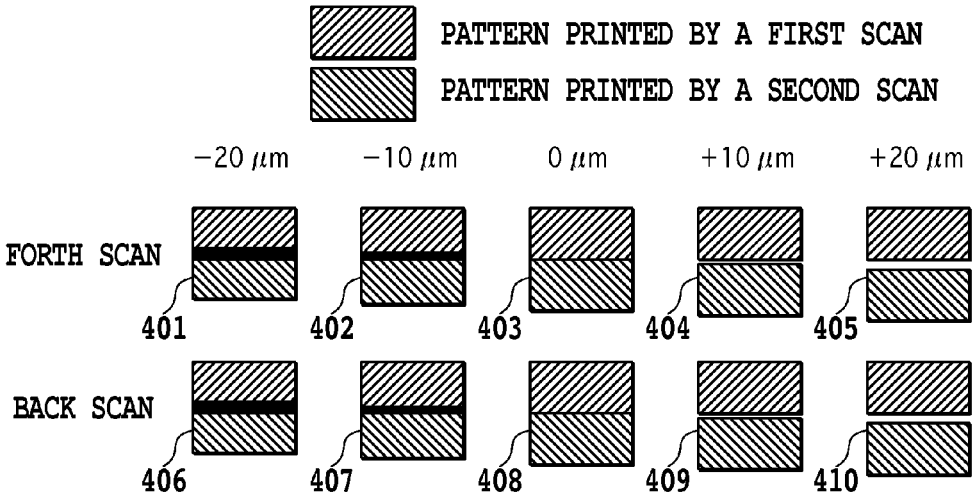
FIGS. 7A to 7C are views each showing an example of test patterns according to an embodiment of the present invention.
Figure 7B:
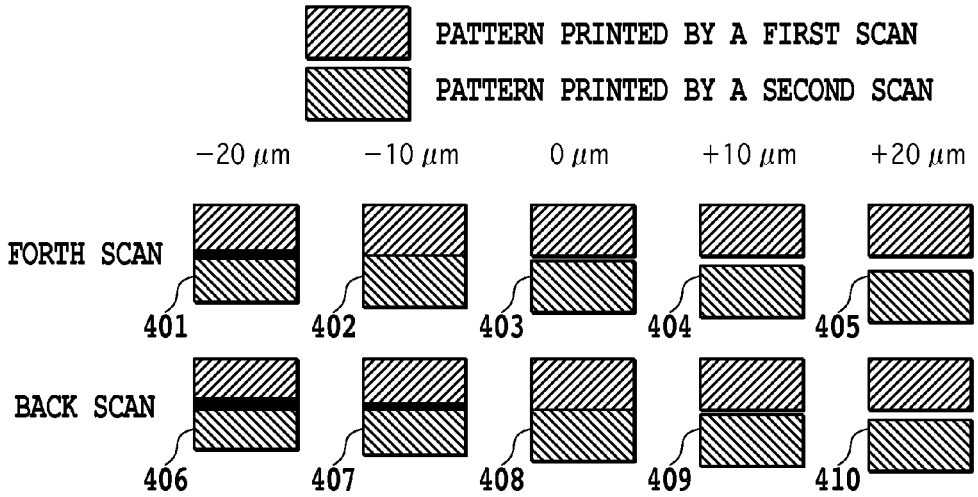
Figure 7C:
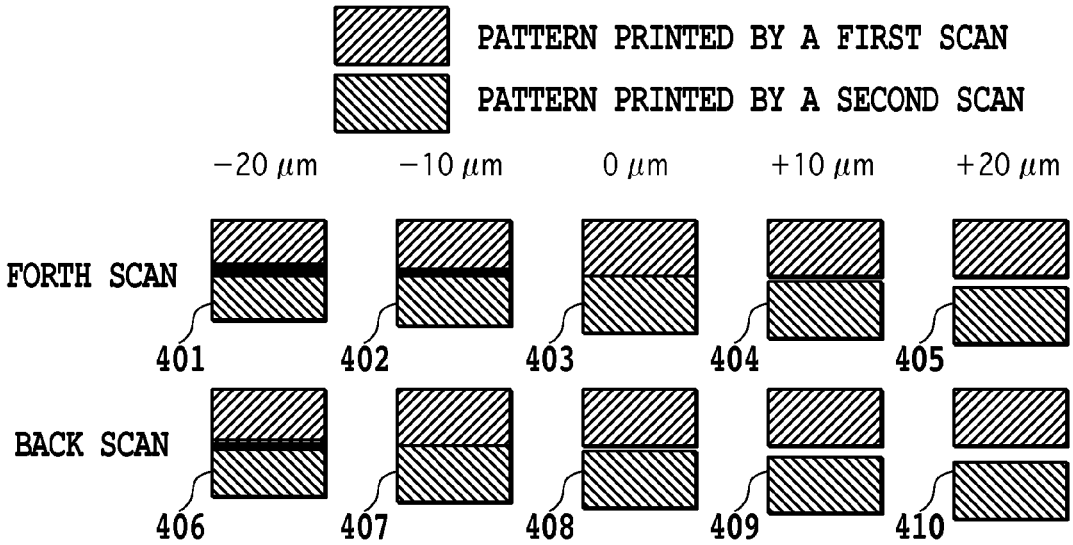
Figure 8:
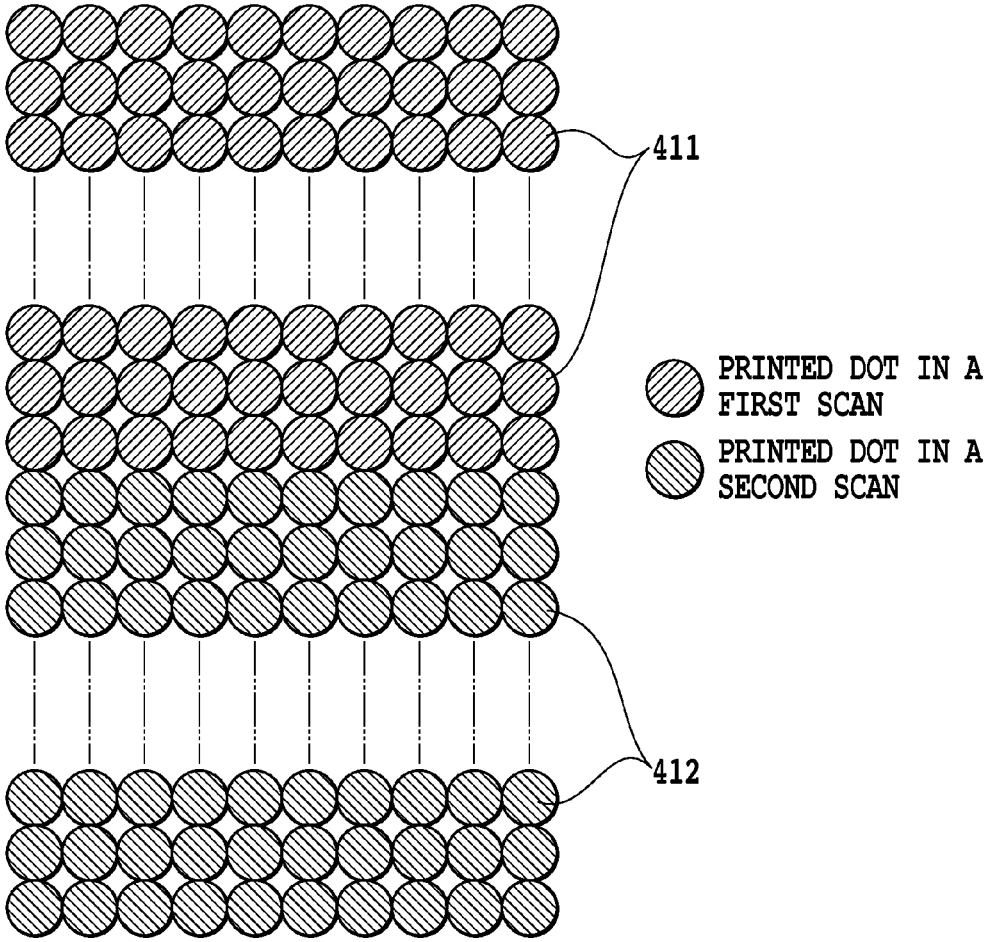
FIG. 8 is a view showing a dot array of the test pattern.

Here, FIGS. 7A, 7B and 7C show examples of test patterns. FIG. 8 is a view explaining a method of forming a test pattern. Data of the test pattern described below are stored in the ROM 202, and read out by CPU 201 to make the printing head 5004 form the test pattern.

The test pattern is, as shown in FIG. 7A, composed of 10 test patches 401 to 410, for example. The test patch is formed as follows. As shown in FIG. 8, first, by the first scan of the printing head in the forth direction, an image 411 of 10 dots in the main scan direction is printed by using 64 downstream ink ejection ports. Thereafter, the print medium is carried and an image 412 of 10 dots in the main scan direction is printed by using 64 upstream ink ejection ports under the pattern printed in the first scan. The test patch is thus formed.

In FIG. 7A, a test patch 403 and a test patch 408 as reference respectively to the scan in the forth direction and the scan in the back direction among the 10 test patches are located such that the pattern printed in the first scan is adjacent to the pattern printed in the second scan in the sub-scan direction. On the other hand, test patches 401, 402, 406 and 407 respectively are located such that the pattern printed in the first scan and the pattern printed in the second scan overlap. In addition, the test patch 401 is larger in an overlapping amount of the patterns than the test patch 402, and the test patch 406 is larger in an overlapping amount of the patterns than the test patch 907. On the other hand, test patches 404, 405, 909 and 410 respectively are located such that the pattern printed in the first scan and the pattern printed in the second scan are away from each other. The test patch 405 is more away in terms of a distance between the patterns than the test patch 404, and the test patch 410 is more away in terms of a distance between the patterns than the test patch 409.

FIG. 7B shows a test patch when the landing deviation of ink in the forth direction becomes relatively large. Originally in the test patch 403, the pattern printed in the first scan is adjacent to the pattern printed in the second scan in the sub-scan direction. However, when the landing deviation of ink in the forth direction becomes large, the pattern printed in the first scan and the pattern printed in the second scan are away from each other in the sub-scan direction in the test patch 403 to generate a white stripe. On the other hand, in the test patch 402, the pattern printed in the first scan becomes adjacent to the pattern printed in the second scan in the sub-scan direction, and both of the white stripe and the black stripe are not generated.

FIG. 7C shows a test patch when the landing deviation of ink in the back direction becomes relatively large. However, when the landing deviation of ink in the back direction becomes large, the pattern printed in the first scan and the pattern printed in the second scan are away from each other in the sub-scan direction in the test patch 408 to generate a white stripe. On the other hand, in the test patch 407, the pattern printed in the first scan becomes adjacent to the pattern printed in the second scan in the sub-scan direction, and both of the white stripe and the black stripe are not generated.

Next, a detection of a landing deviation of ink in each of the scan in the forth direction and the scan in the back direction will be explained.

In the test patch 402, as shown in FIG. 7A, the pattern printed in the first scan and the pattern printed in the second scan overlap by 10 μm in the sub-scan direction for printing. Therefore, when the landing of ink in the scan in the forth direction is not larger than the standard landing deviation of ink, a black stripe appears in an adjacent portion between the pattern printed in the first scan and the pattern printed in the second scan in the test patch 402. However, since the landing deviation of ink in the forth direction is larger than the standard landing deviation of ink, an original overlap between the pattern printed in the first scan and the pattern printed in the second scan is cancelled as shown in FIG. 7B. Therefore, the test patch 402 is formed as a test patch of a uniform print density. On the other hand, since the landing deviation of ink in the back direction is the same as the standard landing deviation of ink, the test patch 408 is formed as a test patch of a uniform print density as shown in FIG. 7B. Thus it is detected that the landing deviation of ink in the forth direction is larger by 10 μm than the landing deviation of ink in the back direction.

As described above, a difference in the landing deviation of ink between the scans in the back and forth directions can be detected by selecting an image of a uniform print density from the test patches produced by changing the landing deviation in the sub-scan direction between the patterns printed in the first scan and the second scan. It should be noted that the print density can be acquired, for example, by measuring a reflective optical density using an optical sensor in regard to five patches produced in each of the scans in the back and forth directions. In addition, by selecting a test patch in which an output value having a high reflective optical density can be acquired at the optical measurement using the optical sensor, a test patch in which the dot arrangement is uniform without any white stripe and black stripe can be detected. In addition, here, for simplification of explanation, the arrangement for producing the aforementioned test pattern and detecting the information in regard to the landing deviation of ink in each of the scans in the back and forth directions is shown. That is, the aforementioned explanation shows the arrangement in which the test pattern in which the dot arrangement is the most uniform is selected by the optical sensor and a difference in the landing deviation of ink between the scans in the back and forth directions is detected based upon the landing deviation of ink in each scan direction at the time of forming the test patch. However, the present embodiment is not limited to this arrangement, but may adopt the arrangement where, for example, an optical characteristic of each patch is measured, and the test patch having the highest reflective optical density and the test patch having the second highest reflective optical density are selected to calculate a difference in the reflective optical density between the two test patches. In addition, when the difference in the reflective optical density is more than a predetermined value, the landing deviation of the test patch having the highest reflective optical density may be adopted as information in regard to an inclination deviation as it is, and when the difference in the reflective optical density is less than the predetermined value, an average value between the deviation of the test patch having the highest reflective optical density and the deviation of the test patch having the second highest reflective optical density may be adopted. Further, an approximate straight line or an approximate curve is found according to straight approximation or polynomial approximation from data of optical characteristics of each test patch in the right and left of the test patch having the highest reflective optical density. In addition, information in regard to the inclination deviation can be detected from the two straight lines or curves in the right and left.

In addition, it is not essential to use a sensor for measuring an optical characteristic of each test patch. For example, an arrangement can be employed that a user visually selects a test patch having a most uniform dot arrangement and inputs information regarding the test patch from an operational unit of a printer to acquire the landing deviations of ink.

Other Embodiments

In the above described embodiment, an explanation of an example of a two-path printing that makes the printing head execute tow scans of the unit region so as to complete a print of an image on the unit region. However, the present invention is not limited to the tow-path printing and can be applied to a multi-path printing having a larger number of paths than the two-path printing. For example, in a case of a four-path printing, each of the printing rates during the scans in the back and forth directions can be set to a half of those for the two-path printing shown in Table 2 and 3.

In addition, the present invention also can be applied to an odd number-path printing that makes the printing head execute odd number of scans of the unit region so as to print an image on the unit region. Here, in a case of three-path printing as an odd number-path printing, there are a unit region A where printing is performed in order of the forth scan, the back scan and the forth scan, and a unit region B where printing is performed in order of the back scan, the forth scan and the back scan. Accordingly, set contents of the printing rates are different from each other between the unit regions A and B. For example, as for the unit region A (two forth scans and one back scan), the printing rates in the back and forth directions are set depending on differences between landing deviations of ink in accordance of a printing rate table shown in Table 4. As for the unit region B (one forth scan and two back scans), the printing rates are set depending on differences between landing deviations of ink in accordance of a printing rate table shown in Table 5.

TABLE 4

| | | Difference between back and forth scan [μm] | | | | |
|---|---|---|---|---|---|---|
| | | −20 | −10 | 0 | +10 | +20 |
| Printing rate [%] | Forth scan | 40 | 35 | 33 | 30 | 25 |
| | Back scan | 20 | 30 | 33 | 40 | 50 |

TABLE 5

| | | Difference between back and forth scan [μm] | | | | |
|---|---|---|---|---|---|---|
| | | −20 | −10 | 0 | +10 | +20 |
| Printing rate [%] | Forth scan | 20 | 30 | 33 | 40 | 50 |
| | Back scan | 40 | 35 | 33 | 30 | 25 |

In addition, in the three-path printing, it is possible to differentiate the printing rate between the back and forth directions in a case where the difference between the landing deviations is zero. Further, in not only the three-path printing but also in other odd number-path printing such as a five-path printing and a seven-path printing, the printing rates depending on the difference between the landing deviations are set for every unit region in a similar way.

However, as apparent from the above, when a control for differentiating the printing rates between during the back and forth directions in the odd-path printing is performed, the respective printing rates are different between the unit region A and the unit region B. As a result, the unit regions A and B alternately appear in the sub-scan direction, so that density unevenness between images having a width of the unit region may occur. Therefore, in an apparatus which can execute a printing mode (an even number path mode/a first printing mode) performing a print using an even number path printing and a printing mode (an odd number path mode/a second printing mode) performing a print using an odd number path printing, a control for differentiating the printing rates depending on the landing deviation between the back and forth directions is performed only in the even number path mode. In the odd number of path mode, the printing rates are equalized between in the back and forth directions, for example, in the three-path printing, the printing rates are set as 33% both in the back and forth directions. Or, in a case where the landing deviations between in the back and forth scans are originally different from each other due to the structure of the printer, the printing rates are differentiated by a difference between the landing deviations. That is, in the odd number path printing, the printing rates in the back and forth directions are set such that the difference between the printing rates in the back and forth directions is smaller that in the even path mode. Thereby, it is possible to realize an image printing being capable of alleviate an influence of the landing deviation while suppressing the density unevenness.

In addition, in a case of providing with a plurality of the even number path printing modes, only in part of the even number path printing modes, the printing rates in the back and forth directions can be set depending on the difference between the landing deviations. As shown in FIG. 5, the landing deviation in the sub-scan direction (in the nozzle array direction) tends to occur when the printing rate is high, therefore, in the even number path printing having a relatively small number of paths, the printing rates in the back and forth direction are differentiated from each other depending on the landing deviation. On the other hand, in the even number path printing having a relatively large number of paths, the landing deviation is not so large, therefore, the printing rates in the back and forth directions are equalized to each other. Or, in a case where the landing deviations between in the back and forth scans are originally different from each other due to the structure of the printer, the printing rates are by a difference between the landing deviations. That is, in the even number of printing having a relatively small number of paths, the printing rates are set such that a difference between the printing rates in the back and forth directions is larger than that in the even number of printing having a relatively large number of paths.

In addition, possible density unevenness in the odd number path printing tends to especially occur when number of paths is small (the printing rate is high), therefore, the printing rates in the back and forth directions are equalized to each other in the odd number path printing having a relatively small number of paths. Or, in a case where the landing deviations between in the back and forth scans are originally different from each other, the printing rates are differentiated from each other by a difference between the landing deviations.

On the other hand, in the odd number path printing having relatively large number of paths and a less visible density unevenness, the printing rate in the back and forth directions are differentiated from each other depending on the landing deviation so that an influence of the landing deviation can be alleviated. Further, in the odd number path printing having larger number of paths, in a case where the landing deviation in the sub-scan direction is enough small because of enough low-printing rate, the printing rates in the back and forth directions can be equalized to each other. Also, in a case where the landing deviation of ink in the back and forth directions originally differ from each other, the printing rates in the back and forth directions can be differentiated from each other by the difference between the deviations.

Further, in the embodiment(s) described above, an explanation was made in the only case where a total of the printing rates during the respective scans in the multi-path printing is 100%, however, the total of printing rates in the multi-path printing may be greater than or smaller than 100%.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-186576 filed Aug. 11, 2009, which is hereby incorporated by reference herein in its entirety.

What is claimed is:

1. A printing apparatus comprising:

a scanning unit configured to make a printing head execute scans of a printing medium in back and forth directions, the printing head having a plurality of arrayed ejection ports for ejecting ink; and a controller configured to control the scanning unit and the printing head so as to make the printing head execute multiple scans of a unit region of the print medium and print an image thereon; wherein the controller controls each of printing rates of the printing head during the scans in the back and forth directions so as to lower a printing rate during one of the scans in the back and forth directions than that during the other, wherein the one causes a relatively large landing deviation of ink in an array direction of the ejection ports and the other causes a relatively small landing deviation of ink in the array direction.

2. The apparatus according to claim 1, wherein the controller controls each of the printing rates of the printing head during the scans in the back and forth directions depending on a difference between a landing deviation of ink during the scan in the forth direction and that during the scan in the back direction.

3. The apparatus according to claim 2, further comprising a pattern formation unit configured to form a test pattern for obtaining the deviations during the scans in the back and forth directions.

4. The apparatus according to claim 1, wherein the controller comprises first and second printing modes, wherein the first printing mode makes the printing head execute even number of scans of the unit region and print thereon and the second printing mode makes the printing head execute odd number of scans of the unit region and print thereon, wherein the controller controls each of the printing rates of the printing head during the scans in the back and forth directions so as to lower the printing rate during the one than that during the other in the first printing mode and so as to equalize the printing rate of the scan in the forth direction with that of the scan in the back direction in the second printing mode.

5. The apparatus according to claim 4, wherein the controller controls each of the printing rates of the printing head during the scans in the back and forth directions depending on a difference between a landing deviation of ink during the scan in the forth direction and that during the scan in the back direction in the second printing mode.

6. The apparatus according to claim 1, wherein the controller comprises first and second printing modes, wherein the first printing mode has makes the printing head execute even number of scans of the unit region and print thereon and the second printing mode makes the printing head execute odd number of scans of the unit region and print thereon, wherein the controller controls each of the printing rates of the printing head during the scans in the back and forth directions so as to lower the printing rate during the one than that during the other in the first and second printing mode, wherein a difference between the printing rates of the printing head during the scans in the back and forth directions in the second printing mode is smaller than that in the first printing mode.

7. The apparatus according to claim 1, wherein controller comprises first and second printing mode, wherein the first printing mode has a relatively small number of scans of the unit region by the printing head and the second printing mode has a relatively large number of scans of the unit region by the printing head, wherein the controller controls each of the printing rates of the printing head during the scans in the back and forth directions so as to lower the printing rate during the one than that during the other in the first printing mode and so as to equalize the printing rate of the scan in the forth direction with that of the scan in the back direction in the second printing mode.

8. The apparatus according to claim 1, wherein controller comprises first and second printing mode, wherein the first printing mode has a relatively small number of scans of the unit region by the printing head and the second printing mode has a relatively large number of scans of the unit region by the printing head, wherein the controller controls each of the printing rates of the printing head during the scans in the back and forth directions so as to lower the printing rate during the one scan than that during the other scan in the first and second printing mode, wherein a difference between the printing rates of the printing head during the scans in the back and forth directions in the second printing mode is smaller than that in the first printing mode.

9. The apparatus according to claim 1, wherein controller controls each of the printing rates of the printing head during the scans in the back and forth directions with masks defining a permissive pixel of an ink print.

10. A printing method comprising the steps of:

making a printing head execute multiple scans of a unit region of a printing medium in back and forth directions and print an image thereon, the printing head having a plurality of arrayed ejection ports for ejecting ink; and controlling each of printing rates of the printing head during the scans in the back and forth directions so as to lower a printing rate during one of the scans in the back and forth directions than that during the other, wherein the one causes a relatively large landing deviation of ink in an array direction of the ejection ports and the other causes a relatively small landing deviation of ink in the array direction.

* * * * *